United States Patent [19]

Klayman

[11] 3,930,561

[45] Jan. 6, 1976

[54] LOW DISTORTION PYRAMIDAL DISPERSION SPEAKER

[75] Inventor: Arnold I. Klayman, Huntington Beach, Calif.

[73] Assignee: Monitron Industries, Inc., Santa Ana, Calif.

[22] Filed: June 7, 1974

[21] Appl. No.: 477,383

[52] U.S. Cl. ..... 181/192; 181/187; 181/191; 181/195

[51] Int. Cl.[2] ..... G10K 11/00

[58] Field of Search ..... 181/192, 191, 195, 187, 181/177, 152

[56] References Cited

UNITED STATES PATENTS

| | | | |
|---|---|---|---|
| 965,328 | 7/1910 | Prescott | 181/192 |
| 997,870 | 7/1911 | Stevenson | 181/192 |
| 1,381,430 | 6/1921 | Phipps | 181/192 |
| 1,692,994 | 11/1928 | Mattis | 181/195 |
| 1,754,506 | 4/1930 | Flynn | 181/187 |
| 1,777,273 | 9/1930 | Billig | 181/177 |
| 1,996,743 | 4/1935 | Blattner | 181/195 |

*Primary Examiner*—Stephen J. Tomsky
*Attorney, Agent, or Firm*—Nilsson, Robbins, Bissell, Dalgarn & Berliner

[57] ABSTRACT

A loudspeaker horn has a conical section adapted to receive the driver assembly of a speaker system at the small cone end. An exponential section secured to the large cone end, concentrically with the cone longitudinal axis, flares outwardly to terminate in a square cross-section horn mouth. A raised lip secured around the periphery of the horn mouth diffracts sound symmetrically through a dispersion angle of about 120° with a drop of about six decibels or less.

6 Claims, 4 Drawing Figures

LOW DISTORTION PYRAMIDAL DISPERSION SPEAKER

BACKGROUND OF THE INVENTION

The apparatus of this invention relates to speaker systems, and more specifically to a combined conical and exponential horn for use in such speaker systems.

Horns may be classified as conical, exponential and diffraction. The conical type horn, such as a megaphone, produces very little sound distortion but it is also very inefficient. Exponential horns, on the other hand, can provide very high efficiency, but as efficiency increases exponential horns also appear to produce correspondingly greater amounts of distortion. Diffraction horns are constructed to diffract sound around the edges of the horn mouth, thus providing a large angle or degree of sound dispersion. To date, however, it has not been practical to produce diffraction horns which provide the desired degree of dispersion in more than one plane. For example, a diffraction horn might provide adequate dispersion, such as 90°, in the horizontal plane but relatively limited dispersion, such as 50°, in the vertical plane.

All of these previous horns are unable to provide a smooth response when high frequencies are produced at high intensities or decibel levels.

This invention overcomes the deficiencies of the prior art horns by employing a conical section for efficiently coupling the speaker driver to the horn without substantial distortion. An exponential section, secured concentrically to the large end of the conical section, continues the outward flare of the conical section but at an exponential rate to provide the necessary gain in coupling sound to air. The exponential section ends in a square-shaped horn mouth and a raised sound diffraction lip secured around the periphery of the mouth provides a square edge to diffract sound in the shape of a broad-based pyramid around the horn mouth, thereby creating extremely wide sound dispersion in both the horizontal and vertical planes. A typical dispersion angle attained by the horn of this invention is 120° × 120°.

SUMMARY OF THE INVENTION

A loudspeaker horn includes a conical section flaring outwardly from the small cone end and having an exponential section secured to the large cone end concentrically about the longitudinal axis of the conical section. The exponential section flares outwardly to form the horn mouth and means are provided around the horn mouth to diffract sound around the end of the exponential section.

In one embodiment of the invention, the exponential section terminates in the form of a square horn mouth. A raised lip secured around the periphery of the horn mouth is of sufficient height to provide a drop of about six decibels or less as the horn is rotated in a polar dispersion test through 60° in any direction from alignment of its central longitudinal axis with a microphone.

BRIEF DESCRIPTION OF THE DRAWINGS

The invention may best be understood when considered in light of the following detailed description in conjunction with the accompanying drawings, wherein.

DETAILED DESCRIPTION

The horn employed in describing the invention hereinafter is designed specifically for use in the 2,400–15,000 hertz range. It will be understood that by varying the horn dimensions, as will be apparent hereinafter to one skilled in the art, the embodiment described herein may be modified for use in other frequency ranges and to provide other gains.

Figure 1:
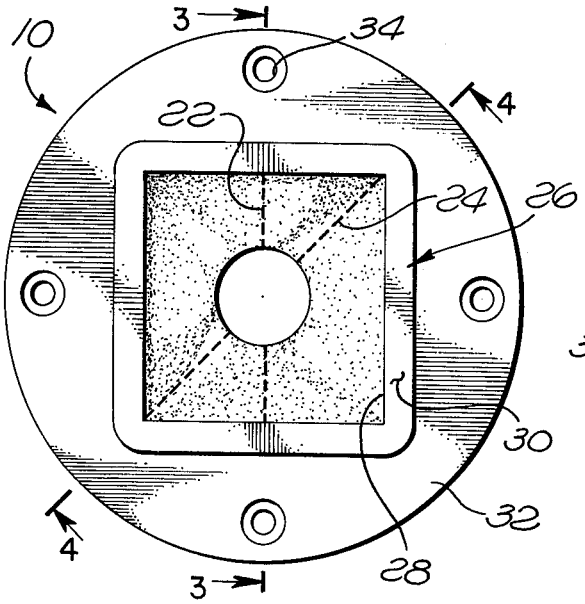
FIG. 1 is a front elevational view of the horn of this invention.
Figure 2:
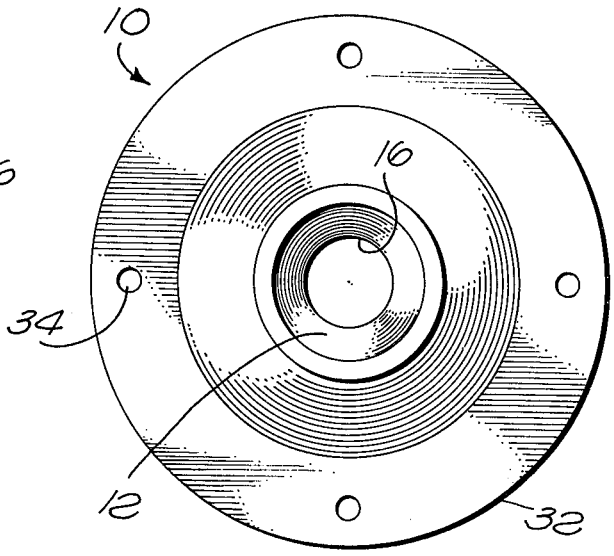
FIG. 2 is a rear elevational view of the horn shown in FIG. 3.
Figure 3:
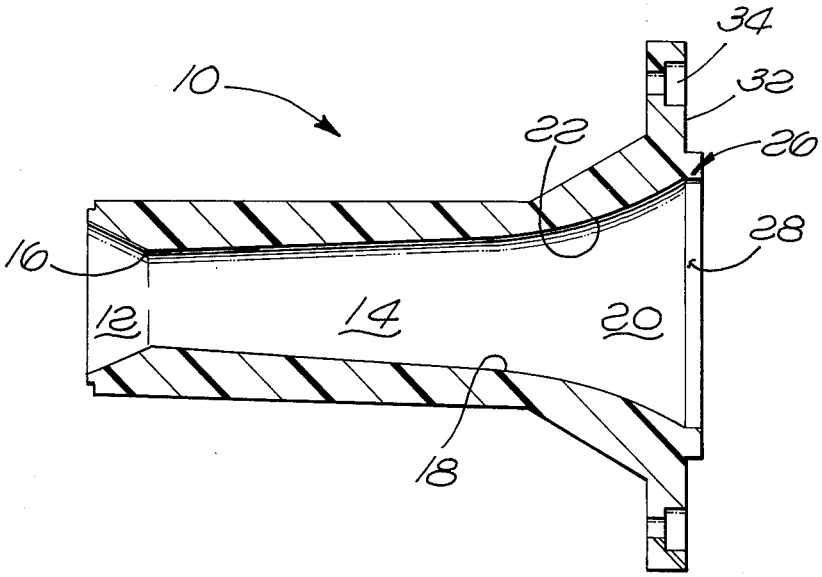
FIG. 3 is a sectional view taken along the line 3—3 of FIG. 1.
Figure 4:
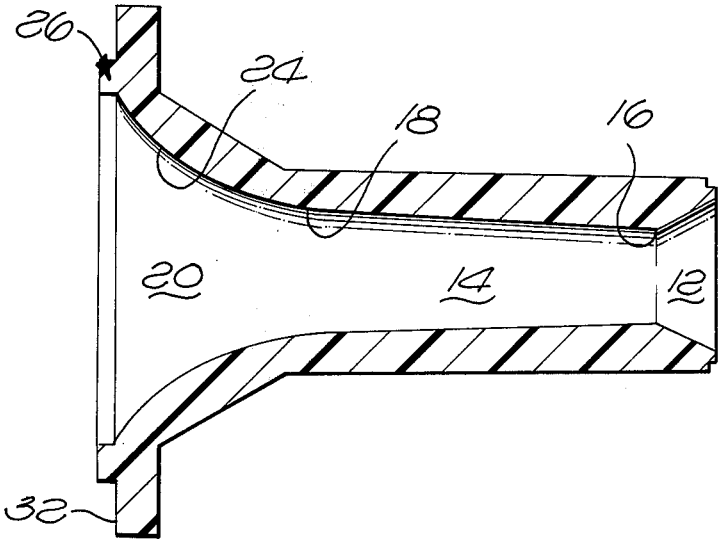
FIG. 4 is a sectional view taken along the line 4—4 of FIG. 1.

In the embodiment of this invention shown in FIGS. 1–4, the horn is an integrally molded unit 10 composed of a glass-filled polyester compound, styrene, styrene foam, or the like. A mating section 12 is formed in any desired shape to receive the appropriate speaker driver to be used with the particular speaker system for which the horn is designed. In this particular embodiment, the driver consists of a conical phasing plug over a diaphragm so that the mating or driver receiving section 12 is molded in the shape of a cone to receive the phasing plug.

A cone-shaped driver coupling section 14 couples the horn to the driver with maximum efficiency and minimum distortion. The driver receiving section 12 is secured to the small end 16 of the driver coupling section 14 which flares outwardly towards the mouth of the horn and terminates at the large cone end 18.

In this embodiment of the invention, the conical or driver coupling section 14 has a circular conical cross-section throughout and is about 0.6 inches in diameter at the small end 16 and about 0.8 inches in diameter at the large end 18. The driver coupling section ideally has a minimum length between its ends 16 and 18 equal to about one wave length of the lowest expected frequency. In this embodiment of the invention, however, the conical section 14 is about 2.25 inches long and the exponential section 20, to be described hereinafter, is about 1.7 inches long.

A sound-to-air coupling section 20 is secured to the outer end 18 of the conical section 14 to provide the remainder of the gain required in coupling sound to air. The sound-to-air coupling section 20 may assume various exponential rates of flare, such as parabolic, hyperbolic or the like, depending upon the desired gain to be achieved by the entire horn. In this embodiment, a gain of 14 decibels was selected in the 2,400–15,000 hertz range of pink noise as measured between the small cone end 16 and the mouth of the horn. In order to provide such a gain, a complicated flare is employed in this embodiment of the invention extending from a circle of about three-quarters inches in diameter to a square of about one one-half inches on a side to form the exponential section 20.

The horn mouth has a square cross-section in order to provide a symmetrical sound dispersion, thus requiring the cross-section of the exponential section to also be approximately square throughout. In turn, the radius at each corner 24 of the exponential section 20 must be less than the radius along the center line 22 of the exponential section walls. In this embodiment of the invention, the radius at each corner 24 is about 1.7 inches while the radius at 22 midway between the corners is about 2.8 inches.

A raised dispersion lip 26 around the outer periphery of the exponential section 20 provides a sound diffraction corner for the horn mouth. The inner lip walls 28 are parallel to the longitudinal axis of the horn and the distance between the inner walls on opposite sides of the mouth is equal to or less than one wave length of the highest frequency expected to be reproduced by the horn. In order to produce a sharp corner for sound dispersion, the inner walls 28 and the top walls 30 of the dispersion lip form a 90° square corner and the height of the inner walls 28 is sufficient, when taken in conjunction with the flare of the exponential section, to provide a six decibel or less drop in a polar dispersion test when the horn is rotated through an angle of 60° or less from alignment of its central longitudinal axis with a microphone. The height of the lip will, of course, vary with the construction of the remainder of the horn, but in this embodiment of the invention a drop of about five decibels is attained where the height of the inner walls 28 is about 0.1 inches and a five and one-half decibel drop is attained where the dispersion lip is eliminated entirely. Thus, the dispersion lip may be unnecessary given the proper flare of the exponential section.

The horn walls are thick enough to prevent resonance of the horn at the anticipated frequencies. In order to make the horn aperiodic, the wall thicknesses must be more than would be required for mere rigidity. This thickness will depend upon the other horn dimensions, the construction material employed, and the anticipated power delivered to the driver. In the described embodiment, the thinnest portion of any wall of the conical and exponential sections is about 0.45 inches.

A flange 32 formed integrally around the outer end of the exponential section, but recessed from the lip 26, provides holes 34 for receiving screws, bolts or the like used to secure the horn to the speaker system.

This invention thus provides an apparatus for efficiently reproducing high frequency sound at high intensities with minimum distortion and maximum dispersion. While this invention is especially useful at high frequencies, it is also capable of modification and use at mid-range and low frequencies.

It will be understood that various modifications may be made in the described embodiment without departing from the scope of the invention. For example, the length or shape of the conical section or the height of the dispersion lip may be varied. In addition, the flare of the conical or exponential sections may be changed.

What is claimed is:

1. A loudspeaker horn adapted to be driven by a speaker driver assembly, said horn comprising:

a conical section having a small cone end compatible with said speaker driver assembly, said conical section flaring outwardly to provide substantially distortion-free coupling of the driver to the horn;

an exponential section secured to the large cone end, said exponential section flaring exponentially outward to form a horn mouth, said horn mouth having a square cross-section;

a raised diffraction lip secured around the periphery of said horn mouth; and means preventing any substantial vibration of the horn at the expected frequencies.

2. A loudspeaker horn as defined in claim 1 wherein said exponential section is symmetrical about the longitudinal axis of said cone.

3. A loudspeaker horn as defined in claim 2 wherein the inner wall of said diffraction lip is parallel to the longitudinal axis of said horn.

4. A horn as defined in claim 3 wherein said lip has a height sufficient to create a drop of about six decibels or less as the horn is rotated in a polar dispersion test through at least 60° in any direction from alignment of its central longitudinal axis with a microphone.

5. A horn as defined in claim 4 wherein said conical section is a circular cone.

6. A horn as defined in claim 5 wherein:

the inner wall of said diffraction lip is about 0.1 inches high and forms an angle of about 90° with the lip outer surface; and, said vibration preventing means includes walls of said conical and exponential sections sufficiently thick to provide an aperiodic horn in the expected frequency range.

* * * * *